US010899534B2

(12) United States Patent
Ellonen et al.

(10) Patent No.: US 10,899,534 B2
(45) Date of Patent: Jan. 26, 2021

(54) DISPENSER FOR DISPENSING SHEET PRODUCTS

(71) Applicant: Essity Hygiene and Health Aktiebolag, Gothenburg (SE)

(72) Inventors: Matti Ellonen, Ismaning (DE); Alessandro Galata, Ismaning (DE); Arnaud Montcru, Saint Ouen (FR); Thomas Le Gall, Kunheim (FR)

(73) Assignee: Essity Hygiene and Health Aktiebolag, Gothenburg (SE)

( * ) Notice: Subject to any disclaimer, the term of this patent is extended or adjusted under 35 U.S.C. 154(b) by 0 days.

(21) Appl. No.: 16/490,235

(22) PCT Filed: Mar. 28, 2018

(86) PCT No.: PCT/EP2018/058022
§ 371 (c)(1),
(2) Date: Aug. 30, 2019

(87) PCT Pub. No.: WO2018/178205
PCT Pub. Date: Oct. 4, 2018

(65) Prior Publication Data

US 2020/0071061 A1 Mar. 5, 2020

Related U.S. Application Data

(63) Continuation-in-part of application No. PCT/EP2017/057459, filed on Mar. 29, 2017.

(51) Int. Cl.
*B65D 5/62* (2006.01)
*B65D 83/08* (2006.01)
(Continued)

(52) U.S. Cl.
CPC ..... *B65D 83/0847* (2013.01); *A47K 10/421* (2013.01); *B65B 11/004* (2013.01);
(Continued)

(58) Field of Classification Search
USPC ..... 221/33–63
See application file for complete search history.

(56) References Cited

U.S. PATENT DOCUMENTS 5,054,612 A 10/1991 Meyer, Jr.
2003/0168467 A1 9/2003 Thoms
(Continued)

FOREIGN PATENT DOCUMENTS

CL 199803033 7/1999
CL 200601270 12/2006
(Continued)

OTHER PUBLICATIONS

International Searching Authority, Search Report and Written Opinion issued in International Application No. PCT/EP2017/057459 dated Dec. 4, 2017 (13 pages).
(Continued)

*Primary Examiner* — Gene O Crawford
*Assistant Examiner* — Ayodeji T Ojofeitimi
(74) *Attorney, Agent, or Firm* — Wood Herron & Evans LLP

(57) ABSTRACT

A dispenser for dispensing sheet products includes a plurality of walls connected to each other, defining an interior volume, and a stack of sheet products received in the interior volume. A removable panel is provided at a top wall of the plurality of walls. The dispenser is configured so that, upon removal of the removable panel, an opening in the top wall for removing sheet products is revealed. The dispenser has a firmness in the range of 20 to 140, in particular, 70 to 90.

19 Claims, 7 Drawing Sheets

(51) Int. Cl.

| | |
|---|---|
| ***A47K 10/42*** | (2006.01) |
| ***B65B 11/00*** | (2006.01) |
| ***B65B 25/14*** | (2006.01) |
| ***B65D 5/54*** | (2006.01) |

(52) U.S. Cl.
CPC ..... *B65B 25/141* (2013.01); *B65D 5/542* (2013.01); *B65D 5/62* (2013.01); *B65D 83/0894* (2013.01)

(56) References Cited

U.S. PATENT DOCUMENTS

| | | | | |
|---|---|---|---|---|
| 2007/0045335 | A1 | 3/2007 | Szymonski et al. | |
| 2007/0262086 | A1 | 11/2007 | Cook et al. | |
| 2010/0258580 | A1 | 10/2010 | Decker et al. | |
| 2013/0228588 | A1* | 9/2013 | Biegger ..... | B65D 83/0847 221/45 |
| 2014/0224698 | A1 | 8/2014 | Policicchio | |

FOREIGN PATENT DOCUMENTS

| | | | |
|---|---|---|---|
| CL | 200202990 | | 2/2007 |
| CL | 200603546 | | 9/2007 |
| CL | 201301805 | | 6/2013 |
| CL | 201402826 | | 2/2015 |
| CN | 1124707 | A | 6/1996 |
| CN | 102369144 | A | 3/2012 |
| CN | 104395201 | A | 3/2015 |
| EP | 0691283 | A2 | 1/1996 |
| EP | 1204570 | A1 | 5/2002 |
| EP | 2392515 | A1 | 12/2011 |
| JP | H10316180 | A | 12/1998 |
| WO | 2009027879 | A2 | 3/2009 |
| WO | 2013188195 | A1 | 12/2013 |

OTHER PUBLICATIONS

International Searching Authority, Search Report and Written Opinion issued in International Application No. PCT/EP2018/058022 dated Jun. 4, 2018 (15 pages).
Hoffmann Eitle, Response filed on behalf of Applicant Essity Hygiene and Health Aktiebolag dated Dec. 19, 2018 (4 pages).
International Searching Authority, Written Opinion of the International Preliminary Examing Authority ssued in International Application No. PCT/EP2018/058022 dated Mar. 13, 2019 (5 pages).
Chilean Patent Office, First Examination Report issued in Chilean Application No. 02759-2019, dated Aug. 19, 2020, original Chilean Report (13 pages) and English translation (5 pages).
Chinese Patent Office, Official Action issued in Chinese Application No. 201880013859.2 dated Jun. 10, 2020 (7 pages).

* cited by examiner

DISPENSER FOR DISPENSING SHEET PRODUCTS

CROSS-REFERENCE TO RELATED APPLICATION

This application is a national stage entry under 35 U.S.C. § 371 of, and claims priority to, International Application No. PCT/EP2018/058022, filed Mar. 28, 2018, which claims the priority of International Application No. PCT/EP2017/057459. The above-mentioned patent applications are incorporated herein by reference in their entireties.

TECHNICAL FIELD

This application relates to a dispenser for dispensing sheet products, which includes a plurality of walls connected to each other, defining an interior volume, and a stack of sheet products, such as tissue paper sheet products, received in the interior volume.

BACKGROUND

Sheet products, such as tissue paper sheet products, are often offered as a stack of sheet products received in a dispenser, e.g., a table top container or a dispensing box, such as a tissue box. The table top container or the dispensing box has an opening through which a user pulls a sheet product in order to remove it from the container or box. In order to facilitate removal of the sheet product from the container or box, adjacent sheet products in the stack may be interfolded with each other. In this way, when removing the top sheet product from the stack and pulling the sheet product completely through the opening in the container or box, the pulled-out sheet product will bring a portion of the next sheet product in the stack out through the opening. Thus, the next sheet product is readily available for gripping and removing from the container or box.

In order to keep the stack of sheet products in the container or box in an uncompromised state, the container or box may be provided with a removable panel which covers the opening thereof. In this case, the removable panel has to be removed to uncover the opening, thus allowing access to the sheet products.

In known dispensers, problems may arise with regard to the dispensability of the sheet products. If the dispensing force, i.e., the force required to remove a sheet product from the dispenser, is too high, the removal process is rendered cumbersome. In some cases, a user may have to use both hands for completely pulling out the sheet product. Also, the sheet product may be damaged, e.g., torn, in this process. If the dispensing force is too low, the removal process may be compromised. In particular, a pulled-out sheet product may not properly bring a portion of the next sheet product in the stack out through the opening. Hence, the next sheet product may not be readily available to the user for gripping and removing from the dispenser.

Further, in known dispensers, problems exist with regard to maintenance of the shape of the dispenser, in particular, during and after the process of uncovering the dispenser opening. Often, the dispenser is deformed in or after this opening process, impairing dispensability of the sheet products. Also, such a deformation of the dispenser may adversely affect its handleability and appearance. For example, information provided on the dispenser may become unidentifiable.

Hence, it would be desirable to provide a dispenser comprising a stack of sheet products which allows for the sheet products to be dispensed in a reliable and efficient manner, while maintaining the integrity of the dispenser.

SUMMARY

To address these and other problems with conventional designs, the present invention proposes a dispenser with the technical features described below.

In one embodiment, the dispenser is a dispenser for dispensing sheet products. The dispenser includes a plurality of walls connected to each other, defining an interior volume, and a stack of sheet products received in the interior volume. A removable panel is provided at a top wall of the plurality of walls. The dispenser is configured so that, upon removal of the removable panel, an opening in the top wall for removing sheet products is revealed. The dispenser has a firmness in the range of 20 to 140, in particular, 70 to 90.

As used herein, the firmness of the dispenser is measured by applying a pressure of 13.9 kPa to the dispenser in a central portion of the top wall in a direction from the top wall towards a bottom wall of the plurality of walls, and, after the lapse of a period of time of 5 seconds after starting the application of the pressure, determining the displacement of the top wall, from its initial position towards the bottom wall, in the central portion thereof where the pressure is applied. The firmness of the dispenser is defined as the displacement of the top wall thus determined, given in multiples of 0.1 mm. To this end, the firmness may be expressed in "displacement units" which are defined as 1 displacement unit equals 0.1 mm of displacement of the top wall as measured during application of the pressure as set forth in the testing procedure described in this paragraph.

Hence, a firmness in the range of 20 to 140 displacement units corresponds to a displacement of the top wall thus determined in the range of 2 mm to 14 mm.

It has been discovered that the firmness of a dispenser thus measured is closely related to the dispensability of the sheet products received in the interior volume and to the maintainability of the dispenser shape. By choosing the firmness in the range of 20 to 140, an adequate dispensing force can be achieved, allowing for the sheet products to be removed in a reliable and efficient manner. In particular, a user can conveniently remove a sheet product without risk of damaging the product in the process. Further, the removal process of subsequent sheet products is not compromised. At the same time, the shape of the dispenser is maintained, in particular, during and after the step of removing the removable panel so as to reveal the opening, thus avoiding deformation of the dispenser, in particular, the opening thereof. Hence, the integrity of the dispenser can be reliably maintained.

The high degree of dispensability and maintenance of shape for dispensers as detailed above, having a firmness in the above-identified range, has been confirmed in numerous consumer tests.

In particular embodiments, the firmness is in the range of 30 to 130, 40 to 130, 50 to 120, 60 to 110, 65 to 100, or 70 to 90. In this way, the dispensability and shape maintenance of the dispenser can be yet further improved.

In one aspect, the dispenser may be a dispensing box, a table top container, a table top dispenser, a tissue box or the like.

The dispenser is configured so that, upon removal of the removable panel, i.e., removal of the removable panel from the top wall, an opening in the top wall for removing sheet products is revealed. For example, the opening in the top wall may be uncovered or formed by removing the removable panel.

In another aspect, the opening may be present only in the top wall of the plurality of walls.

Each of the sheet products received in the interior volume may have a water-absorption capacity in the range of 8 to 18 g/g, 9 to 17 g/g, or 10 to 15 g/g. The choice of such sheet products allows for the dispensability and shape maintenance properties of the dispenser to be further enhanced.

The water-absorption capacity of the sheet products is determined according to European standard ISO 12625-8: 2010.

Each of the sheet products received in the interior volume may have a density in the range of 0.03 g/cm3 to 0.30 g/cm3, 0.03 g/cm3 to 0.25 g/cm3, 0.03 g/cm3 to 0.20 g/cm3, 0.04 g/cm3 to 0.20 g/cm3, or 0.05 g/cm3 to 0.11 g/cm3. Such sheet products offer a particularly high degree of dispensability and allow for the shape of the dispenser to be especially reliably maintained.

In a further aspect, the removable panel may extend to a side wall of the plurality of walls so that a portion of the removable panel is present at the side wall. In this case, the removable panel reaches over an edge, i.e., a side edge, of the top wall to the side wall, i.e., the side wall adjacent to the edge of the top wall.

Thus, the removable panel is present at the top wall and the side wall. The opening may be present only in the top wall or in the top wall and in the side wall.

The top wall may be a substantially planar wall. The side wall may be a substantially planar wall.

The removable panel may extend to the side wall of the plurality of walls so that a portion of the removable panel is present at the side wall, e.g., in the side wall or on the side wall.

The arrangement of the removable panel so that it is provided at the top wall and extends to the side wall, a portion of the removable panel being present at the side wall, allows for the removable panel to be gripped and removed by a user in a simple and efficient manner. In particular, the user can grip the removable panel so that his thumb touches the portion of the removable panel present at the side wall and his index finger touches a part of the removable panel present at the top wall, for example, close to the respective side edge of the top wall adjacent the side wall. In this way, the removable panel, i.e., an end thereof, can be safely and firmly gripped, enabling removal of the panel in a simple, efficient and precise manner.

Hence, this configuration of the dispenser allows for sheet products to be removed in a particularly simple and efficient manner.

In yet another aspect, the plurality of walls may comprise the top wall, the bottom wall opposite the top wall, two opposing side walls and two opposing end walls. In this case, the top wall is connected to the bottom wall through the two side walls and the two end walls.

The bottom wall may be a substantially planar wall. The two side walls and/or the two end walls may be substantially planar walls.

The removable panel may be made of a pliable and/or flexible and/or soft material.

The removable panel may be made of a sheet material, a film material or a foil material, e.g., a plastic sheet or a plastic foil.

The removable panel may be made of a plastic material, such as a polymer material, paper, cardboard, a metal foil or the like. Particularly, the removable panel may be made of a plastic material, e.g., a polymer material, such as polyethylene (PE), polypropylene (PP), polyvinyl chloride (PVC), polyester or the like.

In one aspect, the sheet products received in the interior volume may be household products, kitchen towels, sanitary sheet products, such as tissues, e.g., facial tissues, wipes, e.g., dry wipes or wet wipes, napkins or the like.

The sheet products received in the interior volume may be tissue paper sheet products. The sheet products received in the interior volume may be cellulose based sheet products, in particular, cellulose based tissue paper sheet products. The sheet products received in the interior volume may be nonwoven sheet products.

The sheet products may comprise only cellulose fibers, only synthetic fibers, such as polymer fibers, or a mixture of cellulose and synthetic fibers, such as polymer fibers, as will be further detailed below. The polymer fibers may be, for example, polyolefin fibers, polyester fibers, polyamide fibers etc. For example, the sheet products may be tissue paper sheet products or nonwoven sheet products comprising only cellulose fibers, only synthetic fibers, such as polymer fibers, or a mixture of cellulose and synthetic fibers, such as polymer fibers.

A tissue paper is defined as a soft absorbent paper having a basis weight below 75 g/m2 and typically between 10 and 60 g/m2. Its density is typically below 0.60 g/cm3, below 0.30 g/cm3, or between 0.04 and 0.20 g/cm3. Moist tissue paper webs are usually dried against one or more heated rolls. A method which is commonly used for tissue paper is the so-called Yankee drying. At Yankee drying, the moist paper web is pressed against a steam-heated Yankee cylinder which can have a very large diameter. The paper web is usually creped against the Yankee cylinder.

Another drying method is so called through-air-drying (TAD). In this method, the paper is dried by hot air blown through the moist paper web, often without a preceding wet pressing. In connection with the TAD drying, the patterned structure of the drying fabric is transferred to the paper web. This structure is essentially maintained also in wet condition of the paper, since it has been imparted to the wet paper web.

In the international patent application number PCT/SE98/02461 there is disclosed a method for producing an impulse dried paper, especially tissue paper, having a three-dimensional pattern, said paper having high bulk and softness. Impulse drying involves the moist paper web being passed through the press nip between a press roll or press shoe and a heated roll, which is heated to such a high temperature that a quick and strong steam generation occurs in the interface between the moist paper web and the heated roll. The three-dimensional embossment pattern is accomplished by a pattern provided on the heated roll. The counter means, for example a press felt, against which the paper is pressed in connection with the simultaneous impulse drying and shaping, has a non-rigid surface.

Embodiments of the present invention are configured to work with all types of tissue paper. The tissue paper may be creped or non-creped. The creping may take place in wet or dry condition. It may further be foreshortened by any other methods, such as so-called rush transfer between wires.

In another aspect, the fibers contained in the tissue paper may be mainly pulp fibers from chemical pulp, mechanical pulp, thermo-mechanical pulp, chemo-mechanical pulp and/or chemo-thermo-mechanical pulp (CTMP). The fibers may also be recycled fibers. The tissue paper may also contain or consist of other types of fibers enhancing, e.g., strength, absorption or softness of the paper. These fibers may be made from regenerated cellulose or synthetic material, e.g., polymer material, such as polyolefin, polyesters, polyamides etc. The fibers contained in the tissue paper may be only cellulose fibers, only synthetic fibers, such as polymer fibers, or a mixture of cellulose and synthetic fibers, such as polymer fibers. The polymer fibers may be, for example, polyolefin fibers, polyester fibers, polyamide fibers etc.

The tissue paper coming out from the tissue machine as a single-ply paper sheet may be converted to the final tissue product in many ways, for example embossed, laminated to a multi-ply product, rolled or folded. A laminated multi-ply tissue product comprises at least two tissue plies, which are often joined by either adhesive or mechanically. The adhesive may be applied all over the paper or just in regions, for example, dots or lines, or only along the edges of the product. The mechanical methods are mainly embossing either over the entire area of the plies or only along the edges, so called edge embossing. In the final product, the plies are mostly easily detectable and can often be separated from each other as single plies.

The tissue paper coming out from the tissue paper machine may comprise one or more layers. In the case of more than one layer, this is accomplished either in a multi-layered headbox, by forming a new layer on top of an already formed layer or by couching together already formed layers. These layers cannot^ or only with considerable difficulty^ be separated from each other and are joined mainly by hydrogen bonds. The different layers may be identical or may have different properties regarding, for example, fiber composition and chemical composition.

In a further aspect, the removable panel may be removably attached to at least a portion of the top wall.

Perforations may be provided in the top wall. The perforations penetrate a material of the top wall. The perforations may define at least a part of the removable panel.

The removable panel may be removably attached to a portion of the top wall through perforation bridges arranged between the perforations. In this case, the removable panel can be removed, i.e., removed from the portion of the top wall, by tearing off the panel along the perforations, thus revealing, e.g., forming, the opening in the top wall for removing sheet products.

The perforation bridges may have lengths in the range of 0.5 mm to 3.0 mm, 0.6 mm to 2.5 mm, 0.8 mm to 2.0 mm, or 1.0 mm to 1.8 mm. Such perforation bridges allow for the removable panel to be removed from the portion of the top wall in a particularly controlled manner, further reducing the risk of deformation of the dispenser, in particular, the opening thereof, during the removal process.

A material, e.g., a sheet material, of the top wall may be perforated so as to form the at least a part of the removable panel present at the top wall. In this case, the removable panel is removably attached to a portion, e.g., a remainder, of the top wall through perforation bridges, i.e., portions of top wall material arranged between the perforations.

In yet another aspect, the removable panel may be removably attached to a portion of the top wall in other ways, e.g., through an adhesive or by welding.

For example, the top wall may comprise an opening for removing sheet products which is covered by the removable panel. The removable panel may be removably attached, in a continuous or discontinuous manner, e.g., through an adhesive or by welding, to a region of the top wall surrounding the opening. In this case, the opening in the top wall is uncovered when removing the removable panel.

If the removable panel extends to a side wall of the plurality of walls, perforations may be provided in the side wall to which the removable panel extends. The perforations penetrate a material of the side wall. The perforations may define the portion of the removable panel present at the side wall.

In one aspect, the portion of the removable panel present at the side wall may be removably attached to a portion of the side wall through perforation bridges arranged between the perforations.

A material, e.g., a sheet material, of the side wall may be perforated so as to form the portion of the removable panel present at the side wall. In this case, the portion of the removable panel is removably attached to a portion, e.g., a remainder, of the side wall through perforation bridges, i.e., portions of side wall material arranged between the perforations.

The length of the perforations provided in the top wall and/or the side wall may be in the range of 1 mm to 9 mm, or 2 mm to 8 mm, or 3 mm to 7 mm, or 4 mm to 6 mm.

The length of the perforation bridges provided in the top wall and/or the side wall may be in the range of 0.5 mm to 3.0 mm, 0.6 mm to 2.5 mm, 0.8 mm to 2.0 mm, or 1.0 mm to 1.8 mm.

In another aspect, the perforations provided in the top wall and/or the side wall may be arranged so as to be symmetric with respect to a center line of the removable panel which extends along the width-wise center of the removable panel, i.e., the center of the removable panel in the width direction thereof, i.e., in the direction from the first end wall towards the second end wall of the plurality of walls.

This symmetric arrangement of the perforations ensures that the tearing force during removal of the removable panel is evenly distributed along the removable panel. Hence, the removable panel can be removed in a particularly controlled and precise manner.

In a further aspect, a spacing between adjacent perforation bridges arranged at the side wall may be larger than a spacing between adjacent perforation bridges arranged at the top wall. In this way, the removable panel can be removed in a particularly simple and efficient manner. In particular, the initial stage of the removal process can be facilitated. Moreover, the tactile feeling experienced by a user when removing the removable panel is further improved. In particular, the user experiences two removal stages, the first when removing the portion of the removable panel from the side wall and the second when removing the remainder of the removable panel from the top wall.

The perforations may comprise first perforations at the side wall and second perforations at the top wall. The first perforations may be longer, i.e., have a larger extension, than the second perforations.

The perforations may comprise first perforations at the side wall and at a portion of the top wall in the vicinity of the side wall and second perforations at the remainder of the top wall. The first perforations may be longer, i.e., have a larger extension, than the second perforations. The portion of the top wall in the vicinity of the side wall may extend from a side edge of the top wall adjacent the side wall over between 5% and 20%, 8% and 18%, or 10% and 15% of the length of the top wall in the direction from the first side wall towards the second side wall.

The length of the first perforations may be in the range of 4 mm to 9 mm, or 5 mm to 8 mm, or 6 mm to 7 mm. The length of the second perforations may be in the range of 1 mm to 5 mm or 2 mm to 4 mm.

The length of the perforation bridges provided in the top wall and/or the side wall may be in the range of 0.5 mm to 3.0 mm, 0.6 mm to 2.5 mm, 0.8 mm to 2.0 mm, or 1.0 mm to 1.8 mm.

The number of the first perforations may be in the range of 3 to 15, or 5 to 13, or 7 to 11, for example, 9.

In yet another aspect, a spacing between adjacent perforation bridges at the side wall may be the same as a spacing between adjacent perforation bridges at the entire top wall. In particular, the spacing between adjacent perforation bridges may be substantially constant throughout the entire removable panel.

A perforation may be provided in the side wall at the lowermost part of the portion of the removable panel in the direction from the top wall towards the bottom wall of the plurality of walls. In this way, removal of the removable panel is further facilitated.

A perforation provided in the side wall at the lowermost part of the portion of the removable panel may cross or intersect the center line of the removable panel which extends along the width-wise center of the removable panel.

The perforations may be arranged so that no perforation bridge crosses or intersects the center line of the removable panel which extends along the width-wise center of the removable panel.

In this way, removal of the removable panel is further facilitated. In particular, by arranging the perforations in this manner, a user can remove the portion of the removable panel from the remainder of the side wall more easily. A better grip of this portion by the user is enabled.

In some embodiments, the removable panel, e.g., the entire removable panel, may be formed by a sequence of perforations, the sequence extending from the top wall to the side wall.

In an embodiment, perforations may be present only in the top wall, with no perforations present in the side wall.

In one aspect, the portion of the removable panel present at the side wall may be a tab, such as a pull tab. The tab, in particular, the pull tab, may be a strip of material, e.g., a sheet material and/or a pliable or flexible material. For example, the tab, in particular, the pull tab, may be made of a sheet material, a film material or a foil material, e.g., a plastic sheet or a plastic foil.

The tab, in particular, the pull tab, may be removably attached to the side wall, e.g., through an adhesive or by welding.

The tab, in particular, the pull tab, may be detached from the side wall.

The tab, in particular, the pull tab, may be in contact with the side wall.

In another aspect, the removable panel may extend along the top wall over at least 70%, at least 80%, at least 90%, or at least 95% of the length of the top wall in the direction from the side wall to which the removable panel extends towards the side wall of the plurality of walls which is arranged opposite the side wall to which the removable panel extends. In this way, an opening with a particularly sizeable extension can be revealed by removing the removable panel, thus minimizing friction in the subsequent removal of sheet products through the opening.

The removable panel may be arranged so as not to extend to the side wall of the plurality of walls which is arranged opposite the side wall to which the removable panel extends. In this way, it can be ensured in a particularly reliable manner that a high degree of stability of the dispenser is maintained after removal of the removable panel. Further, the removable panel can be removed in an especially well-defined and precise way.

The removable panel may be arranged so as to extend also to the other side wall, i.e., the side wall of the plurality of walls which is arranged opposite the side wall to which the removable panel extends, so that another portion of the removable panel is present at the other side wall.

The removable panel may extend to a first side wall of the plurality of walls and to a second side wall of the plurality of walls so that a first portion of the removable panel is present at the first side wall and a second portion of the removable panel is present at the second side wall. The first side wall and the second side wall may be arranged opposite each other.

The arrangement of the removable panel so that it extends to the first and second side walls offers a user greater versatility and flexibility for removing the removable panel.

In a further aspect, the first portion of the removable panel and/or the second portion of the removable panel may be provided in any of the configurations detailed above.

The first portion of the removable panel and the second portion of the removable panel may substantially have the same configuration or have configurations which are different from each other. For example, one of the first and second portions may be formed by perforations, i.e., by perforating the side wall, and the other of the first and second portions may be a tab, such as a pull tab. Alternatively, both of the first and second portions may be formed by perforations or be present in the form of tabs, such as pull tabs.

In yet another aspect, the removable panel, e.g., the entire removable panel, may be formed by a sequence of perforations, the sequence extending from the first side wall over the top wall to the second side wall.

The portion of the removable panel present at the side wall may extend along the side wall over between 10% and 50%, between 15% and 45%, between 20% and 40%, or between 25% and 35% of the height of the side wall in the direction from the top wall towards the bottom wall.

The removable panel may be arranged so as not to extend to either of the side walls of the plurality of walls.

In some embodiments, the opening may be present only in the top wall.

The opening in the top wall may have an elongate shape. In this case, the opening extends in the top wall along a longitudinal direction of the opening.

The opening may extend in the top wall, along the longitudinal direction of the opening, over 90% or less, 85% or less, 80% or less, or 75% or less of the length of the top wall in the longitudinal direction of the opening. In this way, it can be particularly reliably ensured that deformation of the dispenser, in particular, the opening thereof, in the process of revealing the opening is avoided.

The opening may extend in the top wall, along a transverse direction of the opening which is perpendicular to the longitudinal direction thereof, over 20% or less, 18% or less, 16% or less, or 15% or less of the width of the top wall in the transverse direction of the opening. Also in this manner, deformation of the dispenser, in particular, the opening thereof, in the process of revealing the opening can be particularly reliably prevented.

In one aspect, the plurality of walls may be made of a pliable and/or flexible and/or soft material.

The plurality of walls may be made of a sheet material, a film material or a foil material, e.g., a plastic sheet or a plastic foil.

The plurality of walls may be made of a plastic material, such as a polymer material, paper, cardboard, a metal foil or the like. Particularly, the plurality of walls may be made of a plastic material, e.g., a polymer material, such as polyethylene (PE), polypropylene (PP), polyvinyl chloride (PVC), polyester or the like.

The plurality of walls may be made of a sheet material. If the removable panel extends to a side wall of the plurality of walls, only a single layer of the sheet material may be present in the region of the side wall in which the portion of the removable panel is present. In this way, removal of the removable panel is further facilitated, in particular, if the portion of the removable panel present at the side wall is defined by perforations, so that the portion of the removable panel is removably attached to a portion of the side wall through perforation bridges.

In another aspect, the side wall to which the removable panel extends, e.g., the first side wall, may have one or more, for example two, three or four, fold over portions in which the sheet material is folded over so that two or more layers of sheet material are arranged on top of each other in the fold over portions.

In these fold over portions, the sheet material may be folded over from lateral edges of the side wall towards the center of the side wall in the width direction of the side wall and/or folded over from a lower edge of the side wall towards the center of the side wall in the height direction of the side wall, i.e., the direction from the bottom wall towards the top wall.

The fold over portions may extend substantially along the entire height of the side wall.

The fold over portions may be arranged so that a gap is present between the fold over portions in the width direction of the side wall. The gap may be provided so that only a single layer of the sheet material is present in the region of the side wall in which the portion of the removable panel is present.

The fold over portions may have a tapered shape in the direction from the lateral edges of the side wall towards the center of the side wall in the width direction of the side wall. Specifically, the fold over portions may be tapered so that an extension thereof along the height of the side wall decreases in the direction from the lateral edges of the side wall towards the center of the side wall. In the center of the side wall in the width direction of the side wall, the fold over portions may extend only along a part, e.g., 60% or less, 50% or less, 40% or less, or 30% or less, of the height of the side wall. The fold over portions may be arranged so that only a single layer of the sheet material is present in the region of the side wall in which the portion of the removable panel is present.

The fold over portions may be folded over so as to at least partially overlap each other. For example, the fold over portions may be folded over so as to overlap each other in an overlap region arranged in the center of the side wall in the width direction of the side wall. In this overlap region, three or more layers of sheet material may be arranged on top of each other.

The fold over portions may have a tapered shape in the direction from the lateral edges of the side wall towards the center of the side wall in the width direction of the side wall. The fold over portions may extend all the way to the lower edge of the side wall in the height direction of the side wall.

In yet another aspect, the at least a part of the removable panel provided at the top wall may have a straight shape, i.e., a shape with straight edges, or a shape with curved or undulating edges. The at least a part of the removable panel provided at the top wall may have a shape with straight edges, the straight edges being substantially parallel to side edges of the top wall adjacent the end walls.

The plurality of walls may substantially have a rectangular prism shape or a cubic shape.

The plurality of walls may substantially have a rectangular prism shape. The at least a part of the removable panel provided at the top wall may have a shape with straight edges, the straight edges being substantially parallel to long side edges of the top wall.

The plurality of walls may substantially have a rectangular prism shape. If the removable panel extends to a side wall of the plurality of walls, the side wall to which the removable panel extends may be arranged at a short side of the rectangular prism shape, i.e., at a short side edge of the top wall. Alternatively, the side wall to which the removable panel extends may be arranged at a long side of the rectangular prism shape, i.e., at a long side edge of the top wall.

The plurality of walls has a height in the direction from the bottom wall towards the top wall. The height may be in the range of 2 cm to 20 cm, 5 cm to 18 cm, 5 cm to 15 cm, 5 cm to 12 cm, 5 cm to 10 cm, 6 cm to 10 cm, 7 cm to 10 cm, or 7 cm to 9 cm.

In some embodiments, the dispenser may further comprise a sleeve arranged so as to at least partially surround the top wall, the two opposing end walls of the plurality of walls and the bottom wall of the plurality of walls. In this way, the stability and robustness of the dispenser are further improved, in particular, during shipping and storing the dispenser. Further, the sleeve can improve the stackability of the dispenser.

The sleeve may extend along the plurality of walls over between 50% and 100%, between 60% and 90%, or between 70% and 80% of the length of the plurality of walls in the direction from one of the two side walls towards the other of the two side walls.

The sleeve may be arranged substantially at a center of the plurality of walls in the direction from one of the two side walls towards the other of the two side walls. In this way, the stability and robustness of the dispenser can be particularly efficiently enhanced.

The sleeve may be slidable relative to the plurality of walls. In particular, the sleeve may be slidable relative to the plurality of walls in the direction from one of the two side walls towards the other of the two side walls. In this way, the sleeve can be removed in a particularly simple manner, facilitating removal of the removable panel and access to the stack of sheet products.

The sleeve may be made of a first material, the plurality of walls may be made of a second material, and the second material may be more flexible and/or more pliable and/or softer than the first material.

The sleeve may be made of cardboard, paper, metal, such as a metal foil, a plastic material, such as a polymer material, the like. Particularly, the sleeve may be made of cardboard.

The sleeve may have a see-through window arranged at the top wall of the plurality of walls. The see-through window may be made of a transparent material or be constituted by an opening in the sleeve.

In a further aspect, the top wall may have a see-through window. The see-through window allows for a portion of the sheet products received in the interior volume to be seen by a user. The see-through window may be made of a transparent material.

The see-through window of the sleeve may be arranged at least substantially over the see-through window of the top wall. In this way, a user can see a portion of the sheet products received in the interior volume also when the sleeve is provided on the plurality of walls.

The see-through window of the sleeve and the see-through window of the top wall may have the same size and/or shape. The see-through window of the sleeve may be arranged entirely over the see-through window of the top wall. The see-through window of the sleeve and the see-through window of the top wall may be arranged so that they are at least substantially congruent with each other.

According to the embodiments of the present invention, adjacent sheet products in the stack of sheet products may be interfolded with each other. In this way, it can be reliably ensured that, upon removal of a sheet product from the interior volume, a portion of the next sheet product in the stack is brought out through the opening.

Adjacent sheet products in the stack of sheet products may not be interfolded with each other. For example, adjacent sheet products may be individually folded but not interfolded with each other. Also, the sheet products may be provided in the stack in unfolded form, e.g., so as to be entirely flat.

In one aspect, an end, e.g., a first end, of the first sheet product in the stack of sheet products, i.e., the uppermost sheet product in the direction from the bottom wall towards the top wall of the plurality of walls, may be folded back, e.g., folded back onto the sheet product.

The end, e.g., the first end, of the first sheet product in the stack of sheet products may be folded back so that the end is arranged at the region of the top wall in which the removable panel is provided. The end, e.g., the first end, of the first sheet product in the stack of sheet products may be folded back so that the end is arranged at the region of the top wall in which the opening is to be revealed.

The end, e.g., the first end, of the first sheet product in the stack of sheet products may be folded back so that the end is aligned substantially along the direction from one of the two side walls towards the other of the two side walls. The end, e.g., the first end, of the first sheet product in the stack of sheet products may be folded back so that the end is aligned substantially along the direction from the first side wall towards the second side wall.

The end, e.g., the first end, of the first sheet product in the stack of sheet products may be folded back so that the end is aligned substantially parallel to the edges, in particular, the straight edges, of the at least a part of the removable panel provided at the top wall. The end, e.g., the first end, of the first sheet product in the stack of sheet products may be folded back so that the end is aligned substantially parallel to the edges, in particular, the straight edges, of the opening which is to be revealed in the top wall.

By folding back the end, e.g., the first end, of the first sheet product in the stack of sheet products, gripping of the sheet product by a user is further facilitated.

Adjacent sheet products in the stack of sheet products may be provided with perforations at least partly penetrating the sheet products and providing a loose connection therebetween. Also in this way, it can be achieved that, upon removal of a sheet product from the interior volume, a portion of the next sheet product in the stack is brought out through the opening. Alternatively or additionally, for this purpose, the sheet products in the stack of sheet products may be chosen so as to have a sufficient degree of surface roughness.

In a further aspect, the stack of sheet products may be received in the interior volume in a compressed state.

The stack of sheet products may be compressed in the direction from the top wall towards the bottom wall.

The stack of sheet products may be received in the interior volume in a substantially uncompressed state.

Moreover, according to a further embodiment, the present disclosure provides a dispenser for dispensing sheet products, the dispenser including a plurality of walls connected to each other, defining an interior volume, and a stack of sheet products received in the interior volume. The dispenser further comprises a sleeve arranged so as to at least partially surround a top wall of the plurality of walls, two opposing end walls of the plurality of walls and a bottom wall of the plurality of walls.

In this way, a dispenser with a particularly high degree of stability and robustness can be provided. In particular, stability and robustness of the dispenser during shipping and storing the dispenser can be improved. Further, the sleeve can improve the stackability of the dispenser.

In one aspect, an opening for removing sheet products may be provided at least in the top wall of the plurality of walls.

A removable panel may be provided at the top wall of the plurality of walls. The dispenser may be configured so that, upon removal of the removable panel, an opening in the top wall for removing sheet products is revealed.

The removable panel may extend to a side wall of the plurality of walls so that a portion of the removable panel is present at the side wall.

In another aspect, the sleeve may extend along the plurality of walls over between 50% and 100%, between 60% and 90%, or between 70% and 80% of the length of the plurality of walls in the direction from a first side wall of the plurality of walls towards a second side wall of the plurality of walls.

The sleeve may be arranged substantially at a center of the plurality of walls in the direction from a first side wall of the plurality of walls towards a second side wall of the plurality of walls. In this way, the stability and robustness of the dispenser can be particularly efficiently enhanced.

The sleeve may be slidable relative to the plurality of walls in the direction from a first side wall of the plurality of walls towards a second side wall of the plurality of walls. In this way, the sleeve can be removed in a particularly simple manner. If the dispenser comprises a removable panel, removal of the removable panel and access to the stack of sheet products can be greatly facilitated.

The sleeve may be made of a first material, the plurality of walls may be made of a second material, and the second material may be more flexible and/or more pliable and/or softer than the first material.

The sleeve may be made of cardboard, paper, metal, such as a metal foil, a plastic material, such as a polymer material, or the like. Particularly, the sleeve may be made of cardboard.

In yet another aspect, the plurality of walls may be made of a pliable and/or flexible and/or soft material.

The plurality of walls may be made of a sheet material, a film material or a foil material, e.g., a plastic sheet or a plastic foil.

The plurality of walls may be made of a plastic material, such as a polymer material, paper, cardboard, a metal foil or the like. Particularly, the plurality of walls may be made of a plastic material, e.g., a polymer material, such as polyethylene (PE), polypropylene (PP), polyvinyl chloride (PVC), polyester or the like.

In a further aspect, the sleeve may have a see-through window arranged at the top wall of the plurality of walls. The see-through window may be made of a transparent material or be constituted by an opening in the sleeve.

The top wall may have a see-through window. The see-through window allows for a portion of the sheet products received in the interior volume to be seen by a user. The see-through window may be made of a transparent material.

The see-through window of the sleeve may be arranged at least substantially over the see-through window of the top wall. In this way, a user can see a portion of the sheet products received in the interior volume also when the sleeve is provided on the plurality of walls.

The see-through window of the sleeve and the see-through window of the top wall may have the same size and/or shape. The see-through window of the sleeve may be arranged entirely over the see-through window of the top wall. The see-through window of the sleeve and the see-through window of the top wall may be arranged so that they are at least substantially congruent with each other.

The features disclosed in connection with the above description of the dispenser of embodiments of the present disclosure may also be applied to the dispenser of the further embodiments, with the aspects combined in any such manner.

According to another embodiment, a method of manufacturing the dispenser is provided.

The method of manufacturing the dispenser includes providing a wall material, providing the wall material with the removable panel, cutting the wall material which has been provided with the removable panel, and folding the cut wall material around a stack of sheet products so that the plurality of walls is formed by the folded wall material and the stack of sheet products is received in the interior volume defined by the plurality of walls.

The manufacturing method of the present disclosure is a method of manufacturing the dispenser described above. Hence, the technical advantages described above for the dispenser of the present disclosure also apply to the manufacturing method of the present disclosure. Moreover, the features disclosed in connection with the above description of the dispenser of the present disclosure may also be applied to the manufacturing method of the present disclosure.

In one aspect, the wall material may be a pliable and/or flexible and/or soft material.

The wall material may be a sheet material, a film material or a foil material, e.g., a plastic sheet or a plastic foil.

The wall material may be a plastic material, such as a polymer material, paper, cardboard, a metal foil or the like.

Particularly, the wall material may be a plastic material, e.g., a polymer material, such as polyethylene (PE), polypropylene (PP), polyvinyl chloride (PVC), polyester or the like.

In another aspect, the removable panel may be used as a cutting mark in the process of cutting the wall material. The cutting mark indicates where, i.e., at which position or positions, the wall material is to be cut. Thus, the wall material can be cut in a particularly precise and efficient manner, without the need to provide an additional cutting mark.

The wall material may be provided with the removable panel by perforating the wall material.

At least a portion of the removable panel may be provided by perforating the wall material.

If the dispenser is manufactured so that the removable panel extends to a side wall of the plurality of walls, the cut wall material may be folded to form the plurality of walls so that only a single layer of wall material is present in the region of the side wall where the portion of the removable panel is present.

The cut wall material may be folded so as to form fold over portions such as those detailed above. The fold over portions may be formed so that only a single layer of wall material is present in the region of the side wall where the portion of the removable panel is present.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, explain the one or more embodiments of the invention.

DETAILED DESCRIPTION

Particular embodiments of the present disclosure will now be described with reference to the accompanying drawings.

Figure 1:
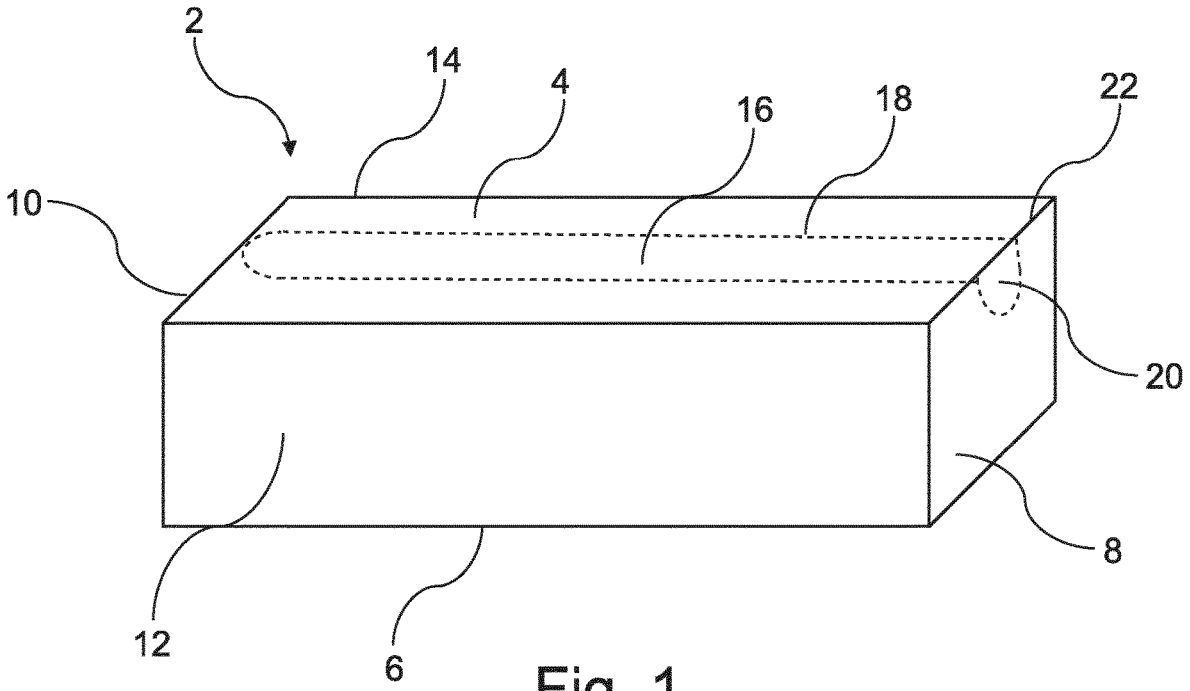
FIG. 1 shows a top perspective view of a dispenser according to a first embodiment.

FIG. 1 shows a schematic perspective view of a dispenser 2 according to a first embodiment of the present disclosure.

The dispenser 2 is a dispenser for dispensing sheet products and includes a plurality of walls connected to each other, defining an interior volume. The plurality of walls includes a top wall 4, a bottom wall 6, a first side wall 8, a second side wall 10 opposite the first side wall 8, a first end wall 12, and a second end wall 14 opposite the first end wall 12. All of these walls 4, 6, 8, 10, 12, 14 are substantially planar walls. As is shown in FIG. 1, the plurality of walls 4, 6, 8, 10, 12, 14 has a rectangular prism shape. The plurality of walls 4, 6, 8, 10, 12, 14 has a height, in the direction from the bottom wall 6 towards the top wall 4, in the range of 2 cm to 20 cm, or 5 cm to 10 cm, for example, 7.5 cm.

The plurality of walls 4, 6, 8, 10, 12, 14 is made of a pliable sheet material, in particular, a plastic sheet material, e.g., a polymer sheet material, such as polyethylene (PE), polypropylene (PP), polyvinyl chloride (PVC), polyester or the like.

A stack of sheet products (not shown), in particular, a stack of tissue paper sheet products, is received in the interior volume defined by the plurality of walls 4, 6, 8, 10, 12, 14. For example, the sheet products may be cellulose based tissue paper sheet products.

Adjacent sheet products in the stack of sheet products are interfolded with each other. The stack of sheet products is received in the interior volume in a compressed state, i.e., in a state in which the stack of sheet products is compressed in the direction from the top wall 4 towards the bottom wall 6.

A removable panel 16 is provided at the top wall 4 and the first side wall 8. The removable panel 16 is formed by perforations 18 provided in the top wall 4 and the first side wall 8. The perforations 18 penetrate the sheet material of the top wall 4 and the first side wall 8. The removable panel 16 is thus removably attached to portions, i.e., remainders, of the top wall 4 and the first side wall 8 through perforation bridges 19 (see FIG. 9), i.e., portions of top wall material and side wall material arranged between the perforations 18.

Hence, the removable panel 16 is formed by a sequence of perforations 18, the sequence extending from the top wall 4 to the first side wall 8.

Figure 8:
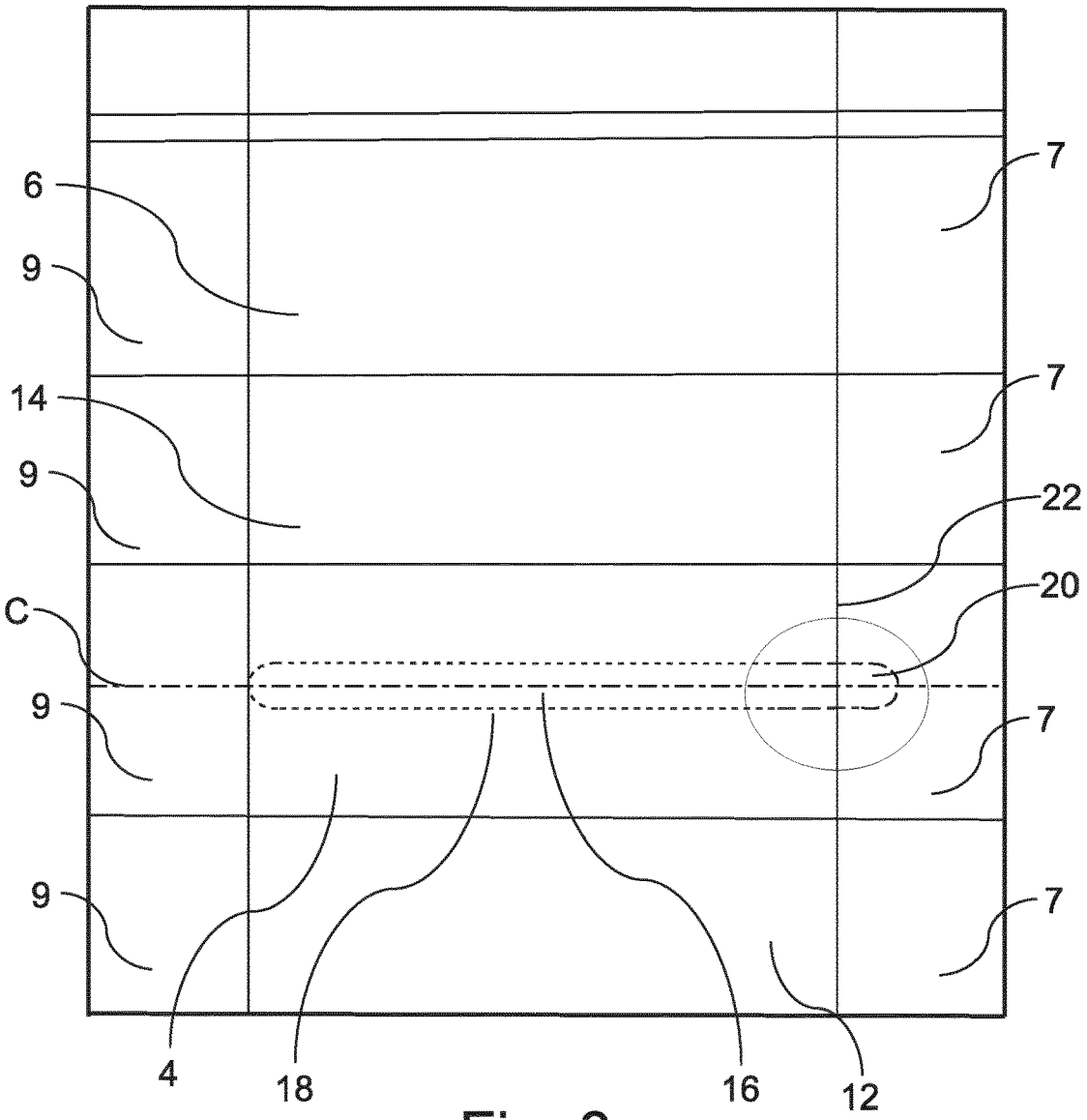
FIG. 8 shows a top plan view of the dispenser of FIG. 1 in an unfolded state thereof (e.g., in "blank" unassembled form).
Figure 9:
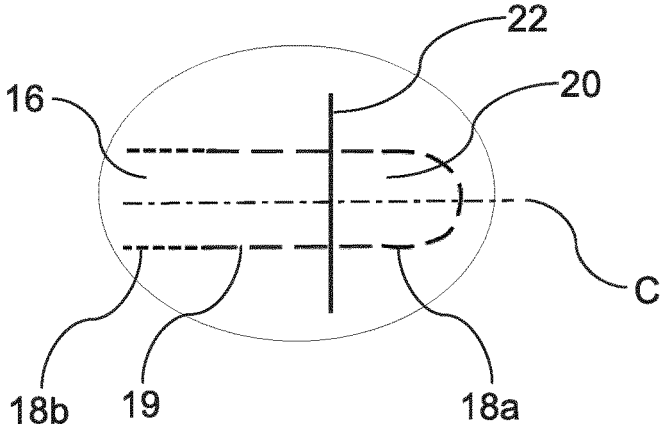
FIG. 9 shows an enlarged detailed top view of the encircled area in FIG. 8.

These perforations 18 are illustrated in greater detail in FIGS. 8 and 9, wherein FIG. 8 shows a schematic top view of the dispenser 2 in an unfolded state thereof, i.e., a schematic top view of an unassembled blank that can be folded into the dispenser 2, and FIG. 9 shows an enlarged view of the encircled area in FIG. 8.

As is shown in FIG. 8, the blank includes portions forming, in the folded state of the dispenser 2, the top wall 4, the bottom wall 6, the first end wall 12 and the second end wall 14.

Further, the blank includes four side flaps 7 and four side flaps 9 forming the first side wall 8 and the second side wall 10, respectively, in the folded state of the dispenser 2.

The perforations 18 are arranged so as to be symmetric with respect to a center line C of the removable panel 16 which extends along the center of the removable panel 16 in the width direction thereof, i.e., in the direction from the first end wall 12 towards the second end wall 14 (see FIGS. 8 and 9).

This symmetric arrangement of the perforations 18 ensures that the tearing force during removal of the removable panel 16 is evenly distributed along the removable panel 16. Hence, the removable panel 16 can be removed in a particularly controlled and precise manner.

As is illustrated in FIG. 9, the perforations 18 include first perforations 18*a* at the first side wall 8 and at a portion of the top wall 4 in the vicinity of the first side wall 8 and second perforations 18*b* at the remainder of the top wall 4. The first perforations 18*a* are longer, i.e., have a larger extension, than the second perforations 18*b*.

Hence, the spacing between adjacent perforation bridges 19 at the first side wall 8 and at the portion of the top wall 4 in the vicinity of the first side wall 8 is larger than the spacing between adjacent perforation bridges 19 at the remainder of the top wall 4.

Alternatively, a spacing between adjacent perforation bridges 19 at the first side wall 8 may be the same as a spacing between adjacent perforation bridges 19 at the entire top wall 4. In particular, the spacing between adjacent perforation bridges 19 may be substantially constant throughout the entire removable panel 16.

The length of the first perforations 18*a* may be in the range of 4 mm to 9 mm, e.g., 6 mm. The length of the second perforations 18*b* may be in the range of 1 mm to 5 mm. The length of the perforation bridges 19 may be in the range of 0.5 mm to 2 mm, e.g., 1 mm.

The number of the first perforations 18*a* may be in the range of 3 to 15, 5 to 13, or 7 to 11, for example, 9.

As is further illustrated in FIG. 9, one of the first perforations 18*a* is provided in the side wall 8 at the lowermost part of the portion 20 of the removable panel 16 in the direction from the top wall 4 towards the bottom wall 6 (i.e., at the end of the portion 20 on the right-hand side in FIG. 9). This first perforation 18*a* crosses or intersects the center line C. Hence, the first perforations 18*a* are arranged so that no perforation bridge 19 crosses or intersects the center line C.

In this way, removal of the removable panel 16 is further facilitated. In particular, by arranging the first perforations 18*a* in this manner, a user can remove the portion 20 of the removable panel 16 from the remainder of the first side wall 8 more easily, also enabling a better grip of this portion 20.

As is shown in FIG. 1, the removable panel 16 extends from the top wall 4 to the first side wall 8 so that a portion 20 of the removable panel 16 is present at the first side wall 8. In particular, the removable panel 16 reaches over an edge, i.e., the short side edge 22 (see FIGS. 1, 8 and 9), of the rectangular top wall 4 to the first side wall 8. In other embodiments, the removable panel 16 may be arranged so as to be present only at the top wall 4, i.e., so as not to extend to either of the side walls 8, 10.

The removable panel 16 extends along the top wall 4 over approximately the entire length of the top wall 4 in the direction from the first side wall 8 towards the second side wall 10 (see FIG. 1). However, the removable panel 16 does not extend to the second side wall 10, i.e., so as to be present also on the second side wall 10 (see also FIG. 8).

The portion 20 of the removable panel 16 present at the first side wall 8 extends along the first side wall 8 over approximately 30% of the height of the first side wall 8 in the direction from the top wall 4 towards the bottom wall 6.

The part of the removable panel 16 provided at the top wall 4 has a straight shape, i.e., a shape with straight edges, the straight edges being substantially parallel to the long side edges of the rectangular top wall 4.

The ends of the removable panel 16 in the direction from the first side wall 8 towards the second side wall 10 have curved, e.g., semi-circular, shapes, as is shown in FIG. 1.

The removable panel 16 can be removed, i.e., removed from the remainders of the top wall 4 and the first side wall 8, by tearing off the removable panel 16 along the perforations 18. Upon removal of the removable panel 16, an opening in the top wall 4 for removing sheet products is revealed, i.e., formed.

In particular, a user can grip the removable panel 16 so that his thumb touches the portion 20 of the removable panel 16 present at the first side wall 8 and his index finger touches the part of the removable panel 16 present at the top wall 4 in a position close to the short side edge 22 of the top wall 4. In this way, the end of the removable panel 16 which is arranged at the short side edge 22 can be safely and firmly gripped by the user, enabling removal of the removable panel 16 in a simple, efficient and precise manner.

Hence, the dispenser 2 according to the first embodiment allows for the sheet products received in the interior volume to be removed in a simple and efficient manner.

Figure 12:
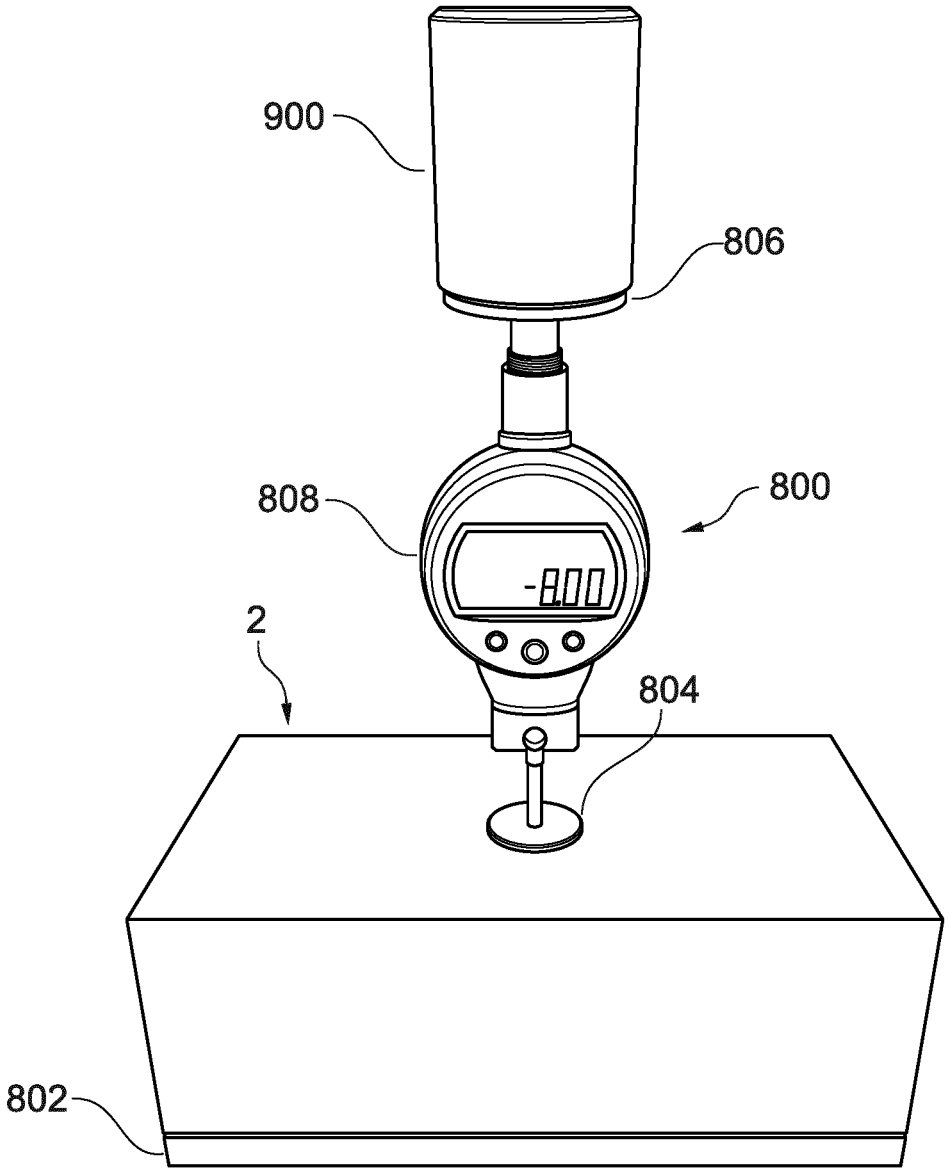
FIG. 12 shows the measurement set-up shown in FIG. 11 during a firmness measurement of the dispenser.

The dispenser 2 as shown in FIG. 12 has a firmness of 80. The firmness of the dispenser 2 is measured by applying a pressure of 13.9 kPa to the dispenser 2 in a central portion of the top wall 4 in a direction from the top wall 4 towards the bottom wall 6, and, after the lapse of a period of time of 5 seconds after starting the application of the pressure, determining the displacement of the top wall 4, from its initial position towards the bottom wall 6, in the central portion thereof where the pressure is applied. The firmness of the dispenser 2 is defined as the displacement of the top wall 4 thus determined, given in multiples of 0.1 mm.

In the following, the process of measuring the firmness of the dispenser 2 will be detailed with reference to FIGS. 10 to 12.

Figure 10:
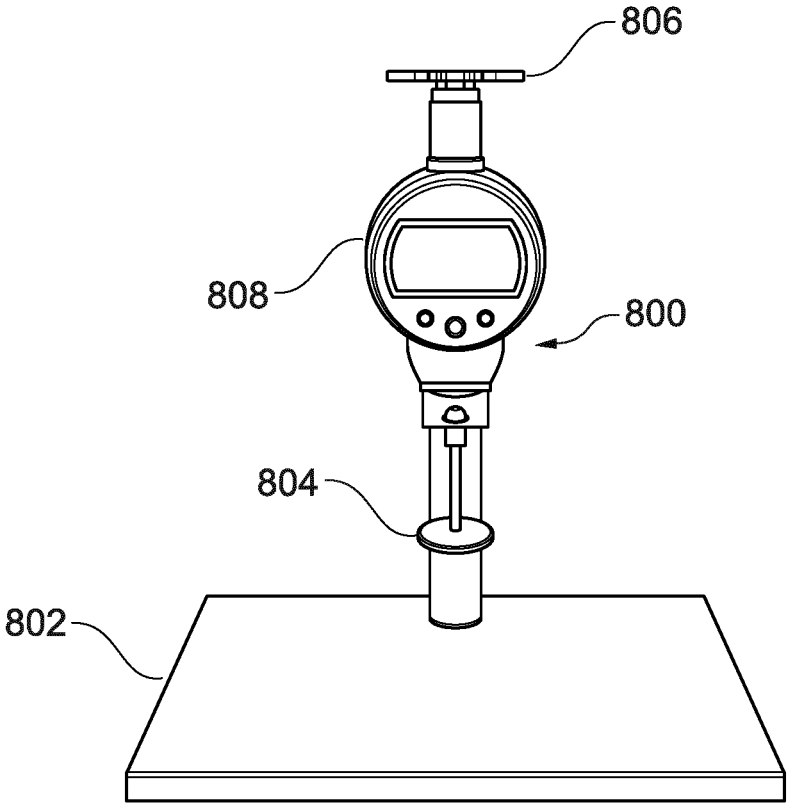
FIG. 10 shows a top perspective view of a measurement set-up for measuring the firmness of a dispenser.

FIG. 10 shows a perspective view of a measurement set-up for measuring the firmness of the dispenser 2. The measurement set-up includes a displacement sensor 800. The displacement sensor 800 is from the company Mitutoyo and has the model number 543-474B and the reference number IDC 25 mm. The displacement sensor 800 includes a support table 802 for placing the dispenser 2 thereon, a probe element 804 for probing the dispenser 2 when placed on the support table 802, a pressure application means 806 for applying pressure to the dispenser 2 when placed on the support table 802, and a control unit 808 for controlling the displacement sensor 800 and displaying the displacement measurement results.

Figure 11:
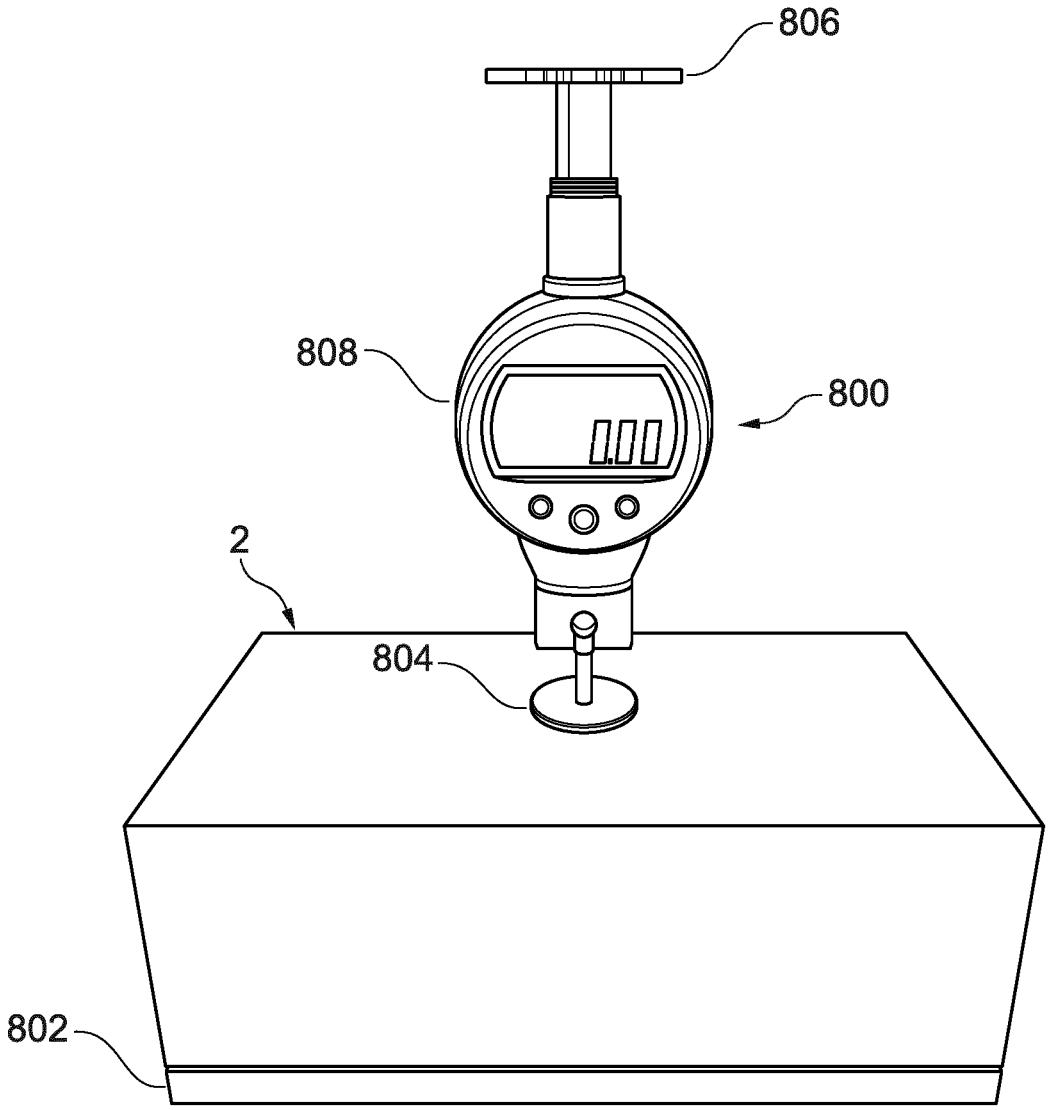
FIG. 11 shows the measurement set-up shown in FIG. 10 with the dispenser according to one of the embodiments of the invention placed in a measurement area of the set-up.

As a first step of the firmness measurement process, the dispenser 2 is placed on the support table 802 so that the top wall 4 thereof faces upward, as is shown in FIG. 11. The vertical position of the probe element 804 is adjusted so that a planar bottom surface of the probe element 804 is brought into contact with the top wall 4 of the dispenser 2 (see FIG. 1) In this arrangement, the top wall 4 is in its initial position, i.e., in the position before the application of pressure to the dispenser 2 starts. The vertical position of the probe element 804 which corresponds to the initial position of the top wall 4 is set as a reference position, i.e., as a position of zero displacement, by correspondingly operating the control unit 808. In this state, the control unit 808 displays a displacement amount of 0.00 mm (see FIG. 11).

As is further shown in FIG. 11, the probe element 804 is arranged in the central portion of the top wall 4, i.e., in a portion of the top wall 4 which is in the center of the top wall 4 in the direction from the first side wall 8 towards the second side wall 10 and in the direction from the first end wall 12 towards the second end wall 14 (see FIG. 1).

After arranging the dispenser 2 and the displacement sensor 800 in this manner, a weight 900, weighing 1 kg, is placed on the pressure application means 806 (see FIG. 12). In this manner, pressure is applied to the dispenser 2, via the weight 900, the pressure application means 806 and the probe element 804, in the central portion of the top wall 4 in the direction from the top wall 4 towards the bottom wall 6. Specifically, the weight 900 of 1 kg presses on the central portion of the top wall 4 over the area of the probe element 804 which is in contact with the top wall 4. The area of the probe element 804 which is in contact with the top wall 4, i.e., the planar bottom surface of the probe element 804, has a circular shape with a diameter of 3 cm. Hence, the pressure applied to the dispenser 2, i.e., to the central portion of the top wall 4, is 13.9 kPa.

After the lapse of a period of time of 5 seconds after starting the application of the pressure to the dispenser 2 by placing the weight 900 on the pressure application means 806, the displacement of the top wall 4, from its initial position towards the bottom wall 6, in the central portion thereof where the pressure is applied is determined. Specifically, this displacement is displayed by the control unit 808. As is shown in FIG. 12, the displacement amount obtained for the dispenser 2 after the lapse of 5 seconds and displayed by the control unit 808 is −8.00 mm, indicating a displacement of the top wall 4 in the negative vertical direction, from the top wall 4 towards the bottom wall 6, by 8.00 mm.

The firmness of the dispenser 2 is defined as the displacement of the top wall 4 thus determined, given in displacement units defining multiples of 0.1 mm. Hence, the displacement amount of 8.00 mm corresponds to a firmness value of 80 displacement units.

By configuring the dispenser 2 so as to obtain a firmness lying in the range of 20 to 140, i.e., a firmness of 80 in the present embodiment, an adequate dispensing force can be achieved, allowing for the sheet products to be removed in a reliable and efficient manner. In particular, a user can conveniently remove a sheet product without risk of damaging the product in the process. Further, the removal process of subsequent sheet products is not compromised. At the same time, the shape of the dispenser 2 is maintained, in particular, during and after the step of removing the removable panel 16 so as to reveal the opening, thus avoiding deformation of the dispenser 2, in particular, the opening thereof. Hence, the integrity of the dispenser 2 can be reliably maintained.

The high degree of dispensability and maintenance of shape for dispensers such as the dispenser 2 of the first embodiment has been confirmed in numerous consumer tests.

Each of the sheet products received in the interior volume of the dispenser 2 has a water-absorption capacity in the range of 8 to 18 g/g, or 10 to 15 g/g. The water-absorption capacity of the sheet products is determined according to European standard ISO 12625-8:2010.

Each of the sheet products received in the interior volume of the dispenser 2 has a density in the range of 0.03 g/cm3 to 0.30 g/cm3, or 0.05 g/cm3 to 0.11 g/cm3.

The dispenser 2 according to the first embodiment is manufactured by providing a wall material for forming the plurality of walls 4, 6, 8, 10, 12, 14, i.e., the pliable sheet material detailed above.

The wall material is provided with the removable panel 16 by perforating the wall material, i.e., by providing the perforations 18 in those portions of the wall material which will form parts of the top wall 4 and the first side wall 8.

Subsequently, the wall material is cut, i.e., cut to size, e.g., using a cutting tool, such as a cutting blade or the like.

In the process of cutting the wall material, the removable panel 16 formed by the perforations 18 is used as a cutting mark. The cutting mark indicates where, i.e., at which position or positions, the wall material is to be cut. Thus, the wall material can be cut in a particularly precise and efficient manner, without the need to provide an additional cutting mark.

As the next step in the manufacturing method, the cut wall material is folded around a stack of sheet products so that the plurality of walls 4, 6, 8, 10, 12, 14 is formed by the folded wall material and the stack of sheet products is received in the interior volume defined by the plurality of walls 4, 6, 8, 10, 12, 14.

Subsequently, the folded wall material is fixed in its position, e.g., by securing portions of the wall material to each other, for example, through an adhesive and/or by welding.

Figure 2:
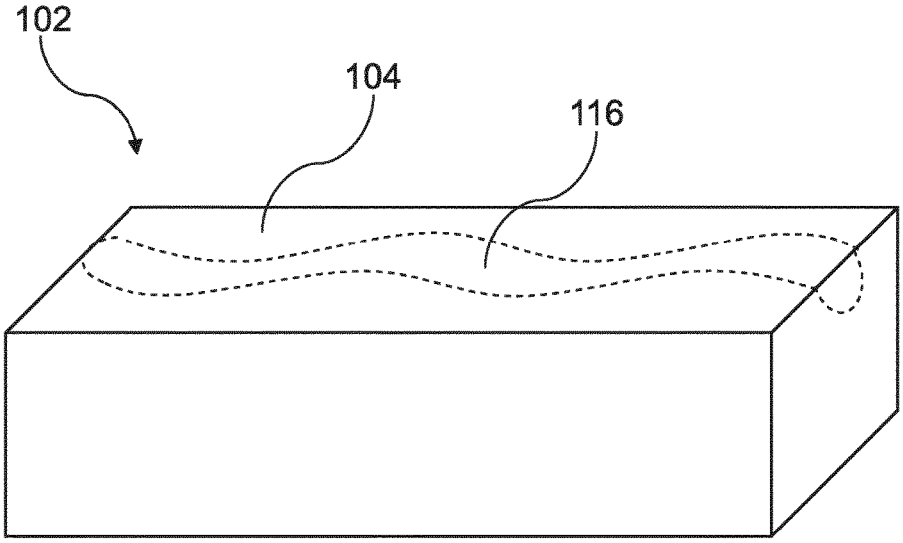
FIG. 2 shows a top perspective view of a dispenser according to a second embodiment.

FIG. 2 shows a schematic perspective view of a dispenser 102 according to a second embodiment of the present disclosure.

The dispenser 102 of the second embodiment differs from the dispenser 2 of the first embodiment only in the shape of the part of the removable panel provided at the top wall. Hence, a repeated description of the configuration of the remainder of the dispenser is omitted.

Specifically, as is shown in FIG. 2, the part of the removable panel 116 provided at the top wall 104 of the dispenser 102 has a shape with undulating edges. The undulations of these edges are arranged so that the direction of their amplitude is substantially perpendicular to the extension direction of the long side edges of the rectangular top wall 104. Further, the undulations are shifted relative to each other along this extension direction, so that the width of the top wall part of the removable panel 116, in the direction perpendicular to the extension direction, periodically varies along the extension direction.

The dispenser 102 according to the second embodiment is manufactured substantially in the same manner as the dispenser 2 according to the first embodiment.

Figure 3:
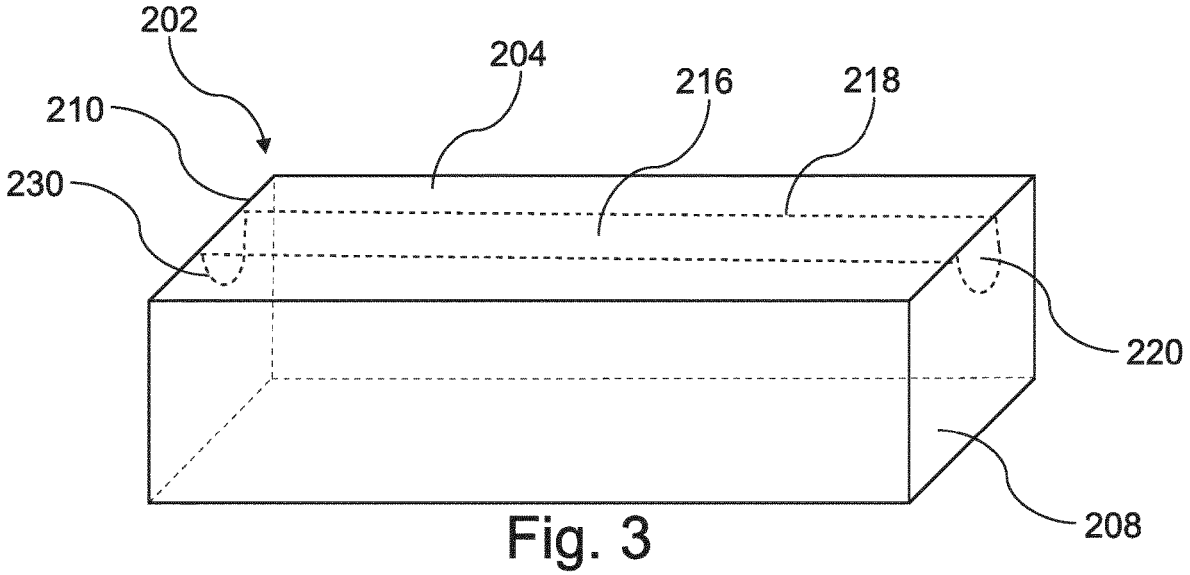
FIG. 3 shows a top partially-transparent perspective view of a dispenser according to a third embodiment.

FIG. 3 shows a schematic transparent perspective view of a dispenser 202 according to a third embodiment of the present disclosure.

The dispenser 202 of the third embodiment differs from the dispenser 2 of the first embodiment only in that the removable panel is arranged so as to extend also to the second side wall. Hence, a repeated description of the configuration of the remainder of the dispenser is omitted.

As is shown in FIG. 3, the removable panel 216 of the dispenser 202 extends to the first side wall 208 and to the second side wall 210 so that a first portion 220 of the removable panel 216 is present at the first side wall 208 and a second portion 230 of the removable panel 216 is present at the second side wall 210. This arrangement of the removable panel 216 offers a user greater versatility and flexibility for removing the removable panel 216.

The first portion 220 of the removable panel 216 and the second portion 230 of the removable panel 216 have the same configuration. Specifically, the first and second portions 220, 230 of the removable panel 216 have the same configuration as the portion 20 of the dispenser 2 according to the first embodiment.

The removable panel 216 is formed by a sequence of perforations 218, the sequence extending from the first side wall 208 over the top wall 204 to the second side wall 210, as is shown in FIG. 3.

The dispenser 202 according to the third embodiment is manufactured substantially in the same manner as the dispenser 2 according to the first embodiment.

Figure 4:
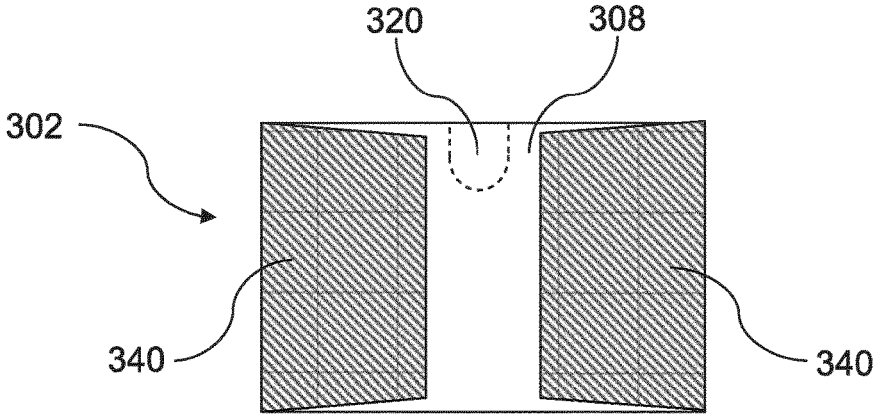
FIG. 4 shows a side view of a dispenser according to a fourth embodiment.

FIG. 4 shows a schematic side view of a dispenser 302 according to a fourth embodiment of the present disclosure.

The dispenser 302 of the fourth embodiment has substantially the same configuration as the dispenser 2 of the first embodiment and differs only in the details of the structure of the first side wall. Therefore, a repeated description of the configuration of the remainder of the dispenser is omitted.

Specifically, as is shown in FIG. 4, the first side wall 308 of the dispenser 302 has fold over portions 340 in which the sheet material is folded over so that two layers of sheet material are arranged on top of each other in the fold over portions 340. In these portions 340, the sheet material is folded over from the lateral edges of the first side wall 308 towards the center of the first side wall 308 in the width direction of the first side wall 308. The fold over portions 340 extend almost along the entire height of the first side wall 308.

The fold over portions 340 are arranged so that there is a gap between the portions 340 in the width direction of the first side wall 308, as is shown in FIG. 4. Thus, only a single layer of the sheet material is present in the region of the first side wall 308 in which the portion 320 of the removable panel is present. In this way, removal of the removable panel is further facilitated.

The dispenser 302 according to the fourth embodiment is manufactured substantially in the same manner as the dispenser 2 according to the first embodiment.

In the method of manufacturing the dispenser 302 of the fourth embodiment, the cut wall material is folded so as to form the fold over portions 340, wherein only a single layer of wall material is present in the region of the first side wall 308 where the portion 320 of the removable panel is present.

Figure 5:
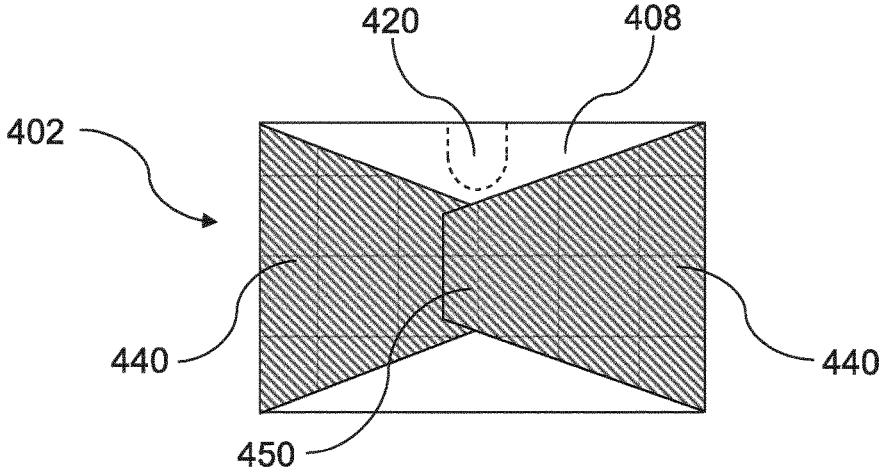
FIG. 5 shows a side view of a dispenser according to a fifth embodiment.

FIG. 5 shows a schematic side view of a dispenser 402 according to a fifth embodiment of the present disclosure.

The dispenser 402 of the fifth embodiment differs from the dispenser 302 of the fourth embodiment only in the configuration and arrangement of the fold over portions.

Hence, a repeated description of the configuration of the remainder of the dispenser is omitted.

As is shown in FIG. 5, the first side wall 408 of the dispenser 402 has fold over portions 440 in which the sheet material is folded over. In these portions 440, the sheet material is folded over from the lateral edges of the first side wall 408 towards the center of the first side wall 408 in the width direction of the first side wall 408.

In contrast to the fold over portions 340 of the dispenser 302, the fold over portions 440 are folded over so as to overlap each other in an overlap region 450 arranged in the center of the first side wall 408 in the width direction of the first side wall 408. In this overlap region 450, three layers of sheet material are arranged on top of each other. In the remainder of the fold over portions 440, two layers of sheet material are arranged on top of each other.

The fold over portions 440 have a tapered shape in the direction from the lateral edges of the first side wall 408 towards the center of the first side wall 408 in the width direction of the first side wall 408. Specifically, the fold over portions 440 are tapered so that an extension thereof along the height of the first side wall 408 decreases in the direction from the lateral edges of the first side wall 408 towards the center of the first side wall 408. In the center of the first side wall 408 in the width direction of the first side wall 408, the fold over portions 440 extend only along a part, e.g., approximately 50%, of the height of the first side wall 408, as is shown in FIG. 5. Hence, only a single layer of the sheet material is present in the region of the first side wall 408 in which the portion 420 of the removable panel is present. In this way, removal of the removable panel is further facilitated, substantially in the same manner as for the dispenser 302 of the fourth embodiment.

The dispenser 402 according to the fifth embodiment is manufactured substantially in the same manner as the dispenser 302 according to the fourth embodiment.

Figure 6:
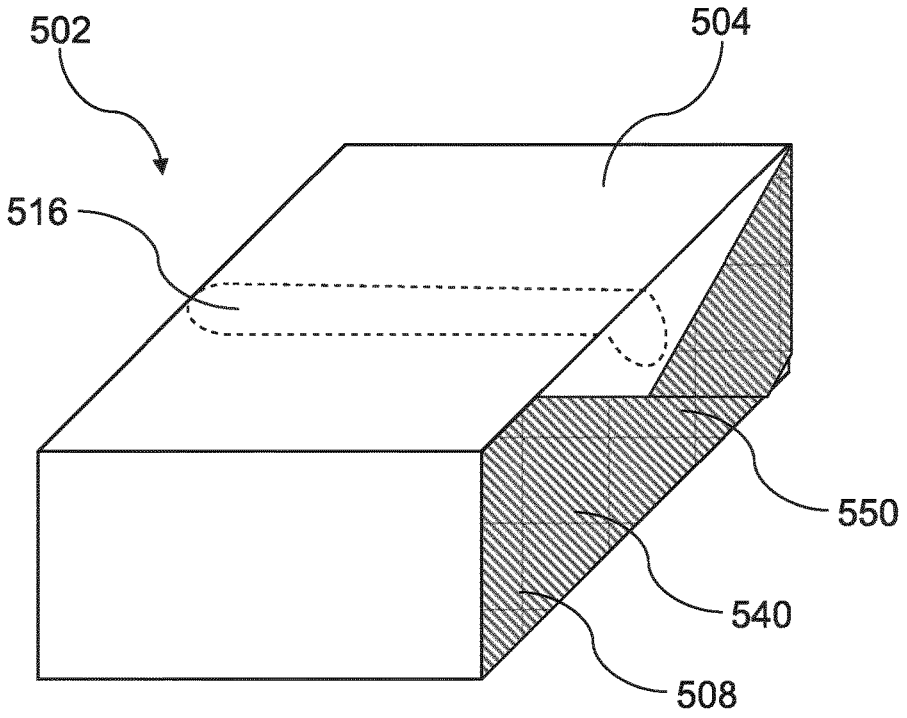
FIG. 6 shows a side perspective view of a dispenser according to a sixth embodiment.

FIG. 6 shows a schematic perspective view of a dispenser 502 according to a sixth embodiment of the present disclosure.

The dispenser 502 of the sixth embodiment differs from the dispenser 402 of the fifth embodiment only in the configuration and arrangement of the fold over portions and in the arrangement of the removable panel. Thus, a repeated description of the configuration of the remainder of the dispenser is omitted.

Specifically, as is shown in FIG. 6, the fold over portions 540 of the dispenser 502 differ from the fold over portions 440 of the dispenser 402 in that the fold over portions 540, including the overlap region 550, extend all the way to the lower edge of the first side wall 508 in the height direction of the first side wall 508.

Moreover, the arrangement of the removable panel 516 differs from the arrangement of the removable panel 16 of the dispenser 2 and the removable panel of the dispenser 402 in that the first side wall 508 to which the removable panel 516 extends is arranged at a long side of the rectangular prism shape of the plurality of walls, i.e., at a long side edge of the top wall 504 (see FIG. 6).

The dispenser 502 according to the sixth embodiment is manufactured substantially in the same manner as the dispenser 402 according to the fifth embodiment.

Figure 7:
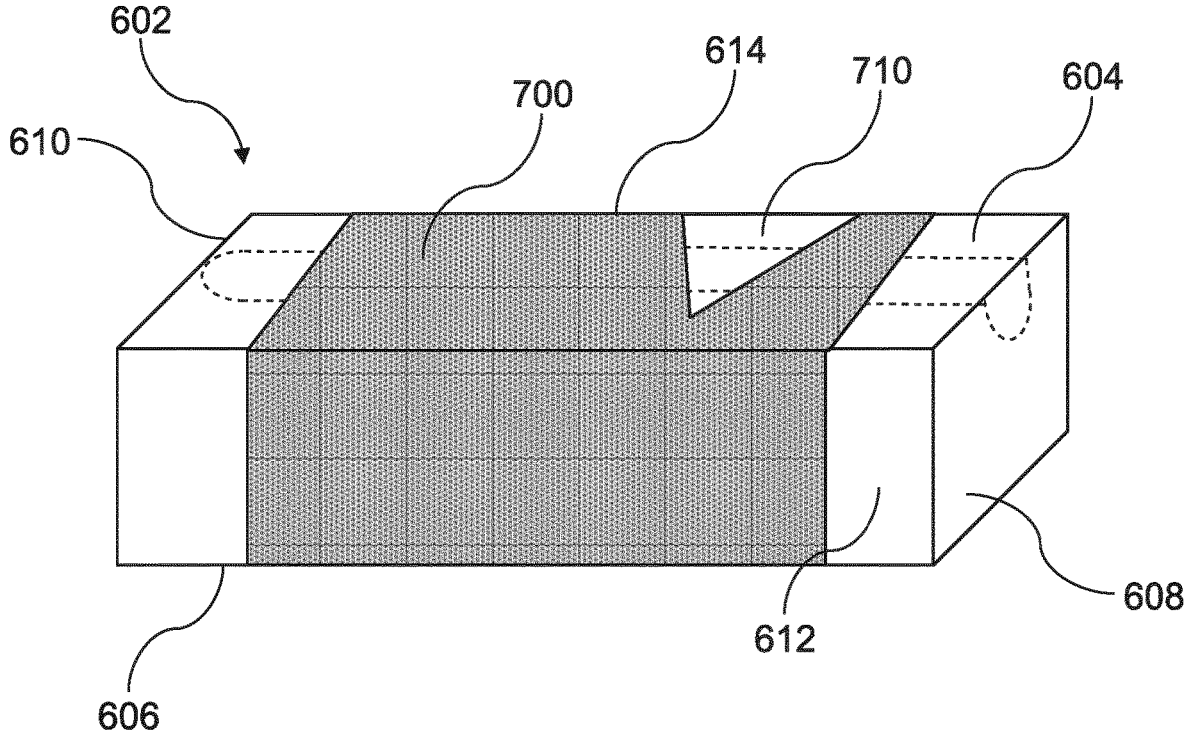
FIG. 7 shows a front perspective view of a dispenser according to a seventh embodiment.

FIG. 7 shows a schematic perspective view of a dispenser 602 according to a seventh embodiment of the present disclosure.

The dispenser 602 of the seventh embodiment differs from the dispenser 2 of the first embodiment only in that an additional sleeve 700 is provided. Hence, a repeated description of the configuration of the remainder of the dispenser is omitted.

As is shown in FIG. 7, the sleeve 700 is arranged so as to partially surround the top wall 604, the two opposing end walls 612, 614 and the bottom wall 606 of the plurality of walls, i.e., so as to surround these walls 604, 606, 612, 614 along a part of their lengths in the direction from the first side wall 608 towards the second side wall 610.

Specifically, the sleeve 700 extends along the plurality of walls over approximately 70% of the length of the plurality of walls in the direction from the first side wall 608 towards the second side wall 610.

The sleeve 700 is made of a material which is less flexible and pliable, i.e., more rigid, than the sheet material of the plurality of walls. In particular, the sleeve 700 may be made of cardboard.

By providing the sleeve 700, the stability and robustness of the dispenser 602 are further improved, in particular, during shipping and storing the dispenser 602. Further, the sleeve 700 improves the stackability of the dispenser 602.

The sleeve 700 is slidable relative to the plurality of walls in the direction from the first side wall 608 towards the second side wall 610. Hence, the sleeve 700 can be removed in a particularly simple manner, facilitating removal of the removable panel and access to the stack of sheet products.

The sleeve 700 has a see-through window 710 arranged at the top wall 604 of the plurality of walls, as is shown in FIG. 7. The see-through window 710 is formed as an opening in the sleeve 700.

Although this is not shown in FIG. 7, the top wall 604 may have a see-through window. The see-through window of the top wall 604 may be made of a transparent material, e.g., a transparent plastic material. Such a see-through window allows for a portion of the sheet products received in the interior volume to be seen by a user.

The see-through window 710 of the sleeve 700 may be arranged at least substantially over the see-through window of the top wall 604. In this way, a user can see a portion of the sheet products received in the interior volume also when the sleeve 700 is slid over the plurality of walls.

The dispenser 602 according to the seventh embodiment is manufactured substantially in the same manner as the dispenser 2 according to the first embodiment. After forming the plurality of walls and fixing them in their position, the sleeve 700 is slid over the plurality of walls in the longitudinal direction of the rectangular prism shape.

To this end, the embodiments described above are only descriptions of preferred embodiments of the present invention, and are not intended to limit the scope of the present invention. Various variations and modifications can be made to the technical solution of the present invention by those of ordinary skills in the art, without departing from the design and spirit of the present invention. The variations and modifications should all fall within the claim scope defined by the claims of the present invention.

What is claimed is:

1. A dispenser for dispensing sheet products, the dispenser comprising:

a plurality of walls connected to each other, defining an interior volume;

a stack of sheet products received in the interior volume; and a removable panel provided at a top wall of the plurality of walls, wherein the dispenser is configured so that, upon removal of the removable panel, an opening in the top wall for removing sheet products is revealed, and wherein the dispenser has a firmness in a range of 70 to 130 displacement units, wherein the firmness of the dispenser is measured by applying a pressure of 13.9 kPa to the dispenser in a central portion of the top wall in a direction from the top wall towards a bottom wall of the plurality of walls, and, after a lapse of a period of time of 5 seconds after starting an application of the pressure, determining a displacement of the top wall, from its initial position towards the bottom wall, in the central portion thereof where the pressure is applied, and the firmness of the dispenser is defined as the displacement of the top wall thus determined, given in displacement units defined as 1 displacement unit equals 0.1 mm of displacement of the top wall as measured during application of the pressure.

2. The dispenser of claim 1, wherein each of the sheet products received in the interior volume has a water-absorption capacity in the range of 10 to 15 g/g, wherein each of the sheet products received in the interior volume has a density in the range of 0.05 g/cm$^3$ to 0.11 g/cm$^3$, wherein the sheet products received in the interior volume are cellulose based tissue paper sheet products, wherein perforations are provided in the top wall, the perforations defining at least a part of the removable panel, wherein the removable panel is removably attached to a portion of the top wall through perforation bridges arranged between the perforations, wherein a length of the perforation bridges is in a range of 0.5 mm to 3.0 mm, wherein the removable panel extends to a side wall of the plurality of walls so that a portion of the removable panel is present at the side wall, wherein the opening in the top wall has an elongate shape, wherein the opening extends in the top wall, along a longitudinal direction of the opening, over 90% or less of a length of the top wall in the longitudinal direction of the opening, wherein the opening extends in the top wall, along a transverse direction of the opening which is perpendicular to a longitudinal direction thereof, over 20% or less of a width of the top wall in the transverse direction of the opening, wherein the plurality of walls is made of a pliable material, wherein the plurality of walls substantially has a rectangular prism shape or a cubic shape, wherein the dispenser further comprises a sleeve arranged so as to at least partially surround the top wall, two opposing end walls of the plurality of walls and the bottom wall, wherein the sleeve is slidable relative to the plurality of walls, wherein the sleeve is made of a first material, the plurality of walls is made of a second material, and the second material is more flexible than the first material, wherein the sleeve has a see-through window arranged at the top wall, and wherein adjacent sheet products in the stack of sheet products are interfolded with each other.

3. The dispenser of claim 1, wherein adjacent sheet products in the stack of sheet products are interfolded with each other.

4. The dispenser of claim 1, wherein the plurality of walls is made of a pliable material.

5. The dispenser of claim 1, wherein the plurality of walls substantially has a rectangular prism shape or a cubic shape.

6. The dispenser of claim 1, wherein the removable panel extends to a side wall of the plurality of walls so that a portion of the removable panel is present at the side wall.

7. The dispenser of claim 1, wherein the sheet products received in the interior volume are cellulose based sheet products.

8. The dispenser of claim 1, wherein each of the sheet products received in the interior volume has a density in a range of 0.03 $g/cm^3$ to 0.30 $g/cm^3$.

9. The dispenser of claim 1, wherein each of the sheet products received in the interior volume has a water-absorption capacity in a range of 8 to 18 g/g.

10. The dispenser of claim 1, wherein perforations are provided in the top wall, the perforations defining at least a part of the removable panel.

11. The dispenser of claim 10, wherein the removable panel is removably attached to a portion of the top wall through perforation bridges arranged between the perforations.

12. The dispenser of claim 11, wherein a length of the perforation bridges is in a range of 0.5 mm to 3.0 mm.

13. The dispenser of claim 1, wherein the opening in the top wall has an elongate shape.

14. The dispenser of claim 13, wherein the opening extends in the top wall, along a longitudinal direction of the opening, over 90% or less of a length of the top wall in the longitudinal direction of the opening.

15. The dispenser of claim 13, wherein the opening extends in the top wall, along a transverse direction of the opening which is perpendicular to a longitudinal direction thereof, over 20% or less of a width of the top wall in the transverse direction of the opening.

16. The dispenser of claim 1, further comprising a sleeve arranged so as to at least partially surround the top wall, two opposing end walls of the plurality of walls and the bottom wall.

17. The dispenser of claim 16, wherein the sleeve is slidable relative to the plurality of walls.

18. The dispenser of claim 16, wherein the sleeve is made of a first material, the plurality of walls is made of a second material, and the second material is more flexible than the first material.

19. The dispenser of claim 16, wherein the sleeve has a see-through window arranged at the top wall.

* * * * *